United States Patent [19]

Perretta

[11] Patent Number: 5,063,845

[45] Date of Patent: Nov. 12, 1991

[54] ANTI-WRAP FOR HIGH SPEED PRINTING PRESS

[75] Inventor: Frank Perretta, Marlboro, N.Y.

[73] Assignee: Perretta Graphics Corporation, Poughkeepsie, N.Y.

[21] Appl. No.: 480,776

[22] Filed: Feb. 16, 1990

[51] Int. Cl.[5] ..... B41F 1/6; B41F 13/60

[52] U.S. Cl. ..... 101/484; 101/226; 101/224; 226/11; 83/371

[58] Field of Search ..... 101/228, 225, 483, 224, 101/226, 227, 484; 226/11, 45; 83/370, 371

[56] References Cited

U.S. PATENT DOCUMENTS

| | | | |
|---|---|---|---|
| 3,404,627 | 10/1968 | Halley | 101/228 |
| 3,638,568 | 2/1972 | Granger | 101/219 |
| 3,881,383 | 5/1975 | Alverth et al. | 83/308 |
| 4,549,485 | 10/1985 | Nawrath | 101/228 X |
| 4,887,532 | 12/1989 | Kotterer | 226/11 |
| 4,966,074 | 10/1990 | Aldrich, Jr. | 101/228 X |

*Primary Examiner*—Edgar S. Burr
*Assistant Examiner*—Christopher A. Bennett
*Attorney, Agent, or Firm*—Joseph L. Spiegel; Joseph B. Taphorn

[57] ABSTRACT

An anti-wrap apparatus and method for high speed printing press involves detecting the start of web wrap after web break to deactivate the press motors and apply the press brakes. In addition the detection mechanism which senses a change in the web path, can sever the already printed web being drawn backwards by the start of web wrap, to limit the availability of web material, for web wrap. In the case of difficult to sever web materials, severing action can be enhanced by forcing the web being drawn backwards, against the severing detection mechanism.

22 Claims, 3 Drawing Sheets

ANTI-WRAP FOR HIGH SPEED PRINTING PRESS

BACKGROUND OF THE INVENTION

1. Field of the Invention

This invention relates to printing presses, and more particularly to high speed printing presses whose blanket cylinder surfaces, printing plates, and mechanisms themselves are all protected against damage on web breaks.

2. Description of the Prior Art

Techniques for stopping a machine which feeds elongated material in the event of breakage of the material are well known. Thus in the patent to Ballard (U.S. Pat. No. 851,214), a lever 70 falls on a paper break to close a stopping circuit. In Veale (U.S. Pat. No. 3,264,740), feelers 58 detect bumps and missing parts to stop the operation of welding apparatus. In Cavanaugh (U.S. Pat. No. 1,776,104), a shoe on arm 32 rides the surface of a web and shuts down the press when paper is absent under the shoe. In Scott (U.S. Pat. No. 2,662,251), a lever 46 falls on a strand break to close a stopping circuit. In Vossen (U.S. Pat. No. 2,747,040), a break in a bobbin thread causes a shift in the needle thread which then displaces lever 52 to close a stop circuit switch. In Howdle et al (U.S. Pat. No. 2,683,195), a plurality of independent shoes 42 each can operate a stop switch in a paper break control device. In Shiba (U.S. Pat. No. 2,896,944) shoes D overlie grooves C on a roll into which they sink on web break. It should be observed that existing detectors essentially do not detect a web break until the break has passed it.

SUMMARY OF THE INVENTION

In high speed printing presses, web breaks result in the web being wrapped around one of the blanket cylinders. This is especially true for the cylinders downstream from the break. And when there are long web leads involved, as when passing from the last printing unit through a long dryer into a chill stand, there are many feet of web to be drawn backwards and wrapped around one of the last pair of printing cylinders. As the wrap builds up on the printing cylinder, it damages the rubber surfaces on the pair of co-acting printing cylinders. Continued wrap build up damages the printing plate co-acting with the blanket cylinder. Further build-up results in so much webbing between the blanket cylinders that the cylinders are severely stressed on their bearings and something gives requiring extensive repair and downtime.

According it is an object of this invention to minimize web-wrap on web break.

A further object of the invention is to provide an associated mechanism for minimizing web-drawback.

Another object of the invention is to promptly detect a web wrapping action and to stop cylinder rotation.

Another object of the invention is to provide an associated mechanism for minimizing web-drawback.

Still another object of the invention is web-wrap detection and web-drawback minimizing mechanisms which are readily installed, simple in operation, easy of construction, and inexpensive of manufacture.

The objects of the invention are achieved by locating a wrap detector feeler in the path of the web being wrapped around a cylinder. If the web is likely to be wrapped around either of two coacting cylinders, then two wrap detectors are employed.

A feature of the invention is that the wrap detector feeler is normally out of contact with the web so that it does not affect the printed inks on the web.

Another feature of the invention is that the wrap detector may be closely positioned to the web cylinders to maximize the speed of wrap detection.

Still another feature of the invention is that the wrap detector may be readily moved to and from the cylinders to provide the printing press operators with unencumbered physical access to the blanket cylinders and printing plates.

A further feature of the invention is that the wrap detector feeler may be formed with a serrated edge for severing the web being wrapped before the printing press with its inertia can be stopped, to thereby limit the web wrap to about half the circumference of a blanket cylinder.

Still another feature of the invention is that the effectiveness of the serrated edge can be enhanced for webs of tough materials.

An advantage of the invention, besides the prevention of damage, is that it greatly reduces the downtime of a printing press that underwent a web break. Having to remove only half a wrap and which does not extend between the co-acting blanket cylinder, is a real time saver. It is a money saver too in that it thereby increases the productivity of the printing press, a very important factor considering printer wage rates and capital investment in high speed printing presses.

BRIEF DESCRIPTION OF THE DRAWINGS

These and other objects, features and advantages of the invention will become apparent from a consideration of the following specification when considered with the appended drawings wherein.

DETAILED DESCRIPTION OF PREFERRED EMBODIMENT

Figure 1:
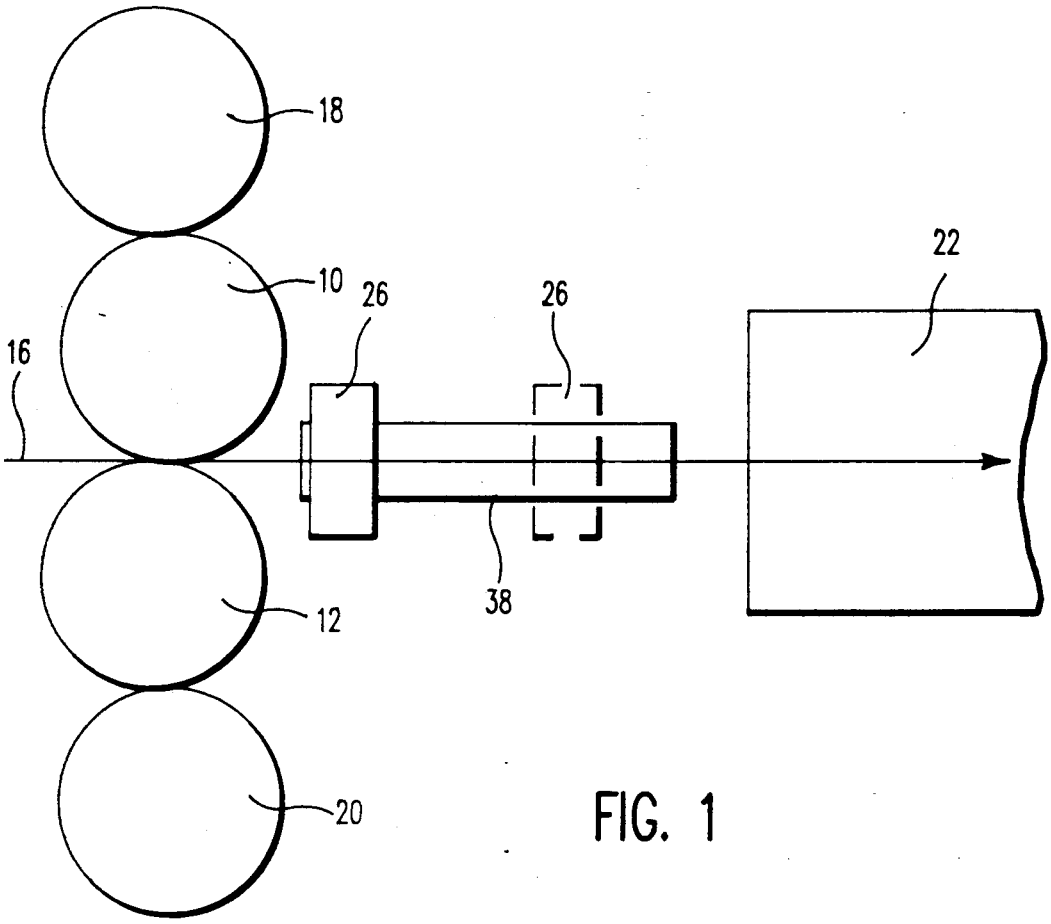
FIG. 1 is a schematic side view of a portion of a high speed printing press embodying the invention.
Figure 2:
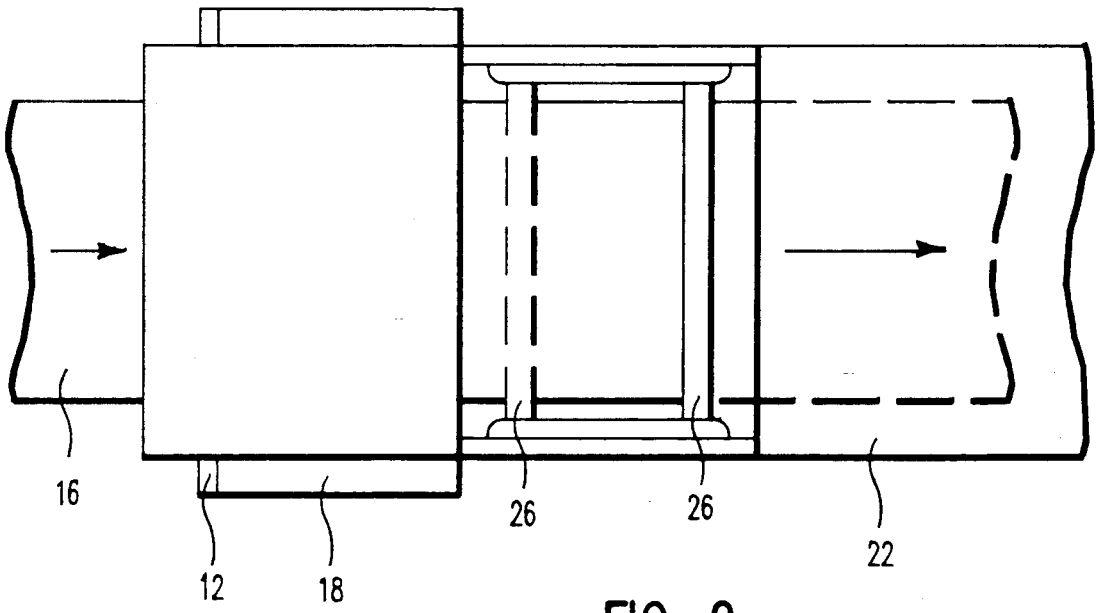
FIG. 2 is a schematic top view of the portion of the printing press of FIG. 1, rotated ninety degrees clockwise.

Referring now to the high speed printing press of FIGS. 1 and 2, there is schematically shown therein an upper blanket cylinder 10 and a lower blanket cylinder 12 which co-act with each other and a paper web 16 passing there between to print both sides of the web. Each of the blanket cylinders 10 and 12 also co-acts with a printing plate bearing cylinders 18 and 20, respectively, to receive wet ink images to be transferred to the web 16. Suitable inking cylinders (not shown) would be co-acting with the printing plate bearing cylinders 18 and 20 to wet the images.

It should be observed that the upper blanket cylinder 10 is shown as further down the web 16 travel path than the lower blanket cylinder 12. It results that if a web break occurs (before the cylinders 10 and 12), the web adheres to the rubber blanket of the later cylinder, and the wrap occurs about the later cylinder, in the travel path, here the upper blanket cylinder 10. The blanket cylinders are staggered for reasons not pertinent to this invention; however the particular staggering does affect which blanket cylinder receives the wrap, and hence the siting of web break detectors.

The amount of wrap that occurs is to some extent a function of the length (lead) of web 16 downstream from the set of co-acting blanket cylinders after the web break and available to be drawn backwards. Long web leads allow for many wraps to occur. If a dryer 22 is downstream from the set of co-acting blanket cylinders, leads of over thirty feet may obtain as that is the length of some dryers; a chill stand may be beyond the dryer increasing the web lead.

Figure 3:
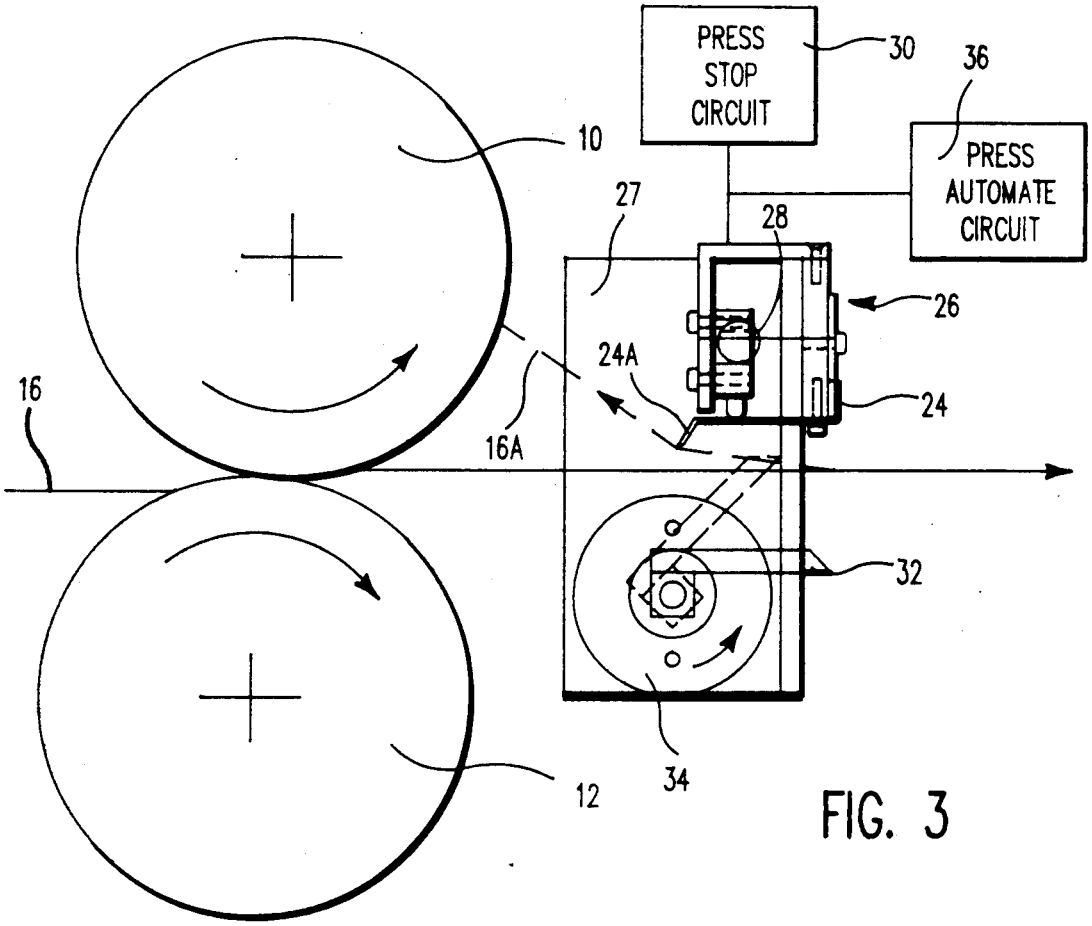
FIG. 3 is an enlarged schematic side view of a portion of the portion of the printing press of FIG. 1 and showing the web wrap detection and serrating mechanism in greater detail.

FIG. 3 shows a single web wrap detector installation for a printing press wherein the upper blanket cylinder 10 is slightly downstream from the lower blanket cylinder 12 and which results, upon any web 16 break before the cylinders 10 and 12, with a wrap taking place on the later or upper cylinder 10 since the free trailing end of the web 16 adheres to its surface. In such a case the web 16 will leave its normal path and assume the dotted line path 16A of FIG. 3. In assuming the dotted line path 16A, the web 16 will engage a web-wide flipper plate or feeler 24 of a wrap detector bar generally indicated by the numeral 26, and supported at its ends on printing press frame mounting brackets 27. One end of the flipper plate 24 loosely engages the underside of the web detector; its free end is gravity biased downward to the limit defined by the heads of set screws in loosely fitting holes in plate 24 and threadedly received in the body of detector 26. The engagement of the flipper plate 24 by the web 16 results in the flipper plate 24 being moved upward on the set screws to close a micro switch 28 in the wrap detector which too completes a standard press stop circuitry 30 to de-energize the motors and apply the brakes.

It will be appreciated that in operation of the press the wrap detector 26 is located as close as possible to the wrap cylinder 10 so that the flipper plate 24 is moved before any significant return movement occurs of the web 16 in the dryer 22 (FIGS. 1 and 2). Thus there is an opportunity to de-energize the motors and energize the brakes before any significant amount of wrap occurs. Considerations of inertia however will cause some wrap to occur before things are brought to a standstill in high speed printing presses moving webs at two-thousand feet a minute.

Figure 4:
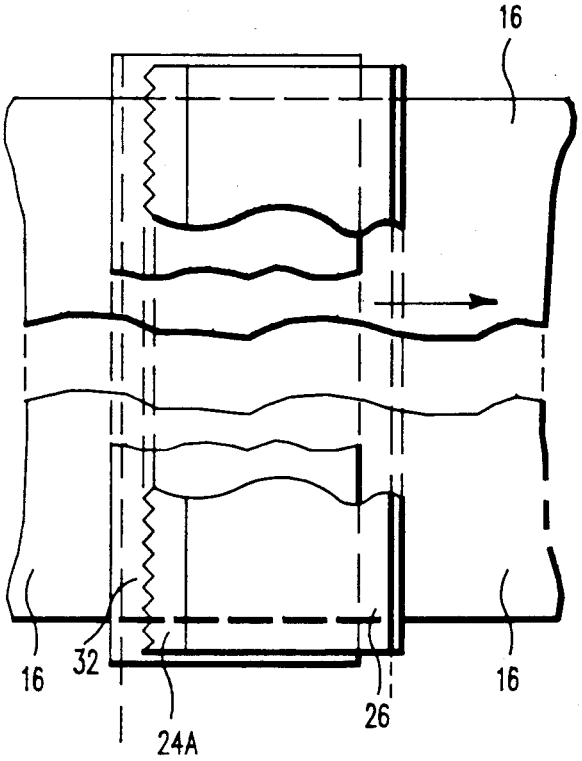
FIG. 4 is a schematic top view of the web wrap detection mechanism of FIG. 3.

It has been discovered that the amount of wrap that takes place on web 16 break can be further curtailed by effecting a second web break, and that this second break can be readily achieved by providing the free end 24A of the flipper plate or feeler 24 with a serrated edge. As best seen in FIG. 4, the flipper plate 24 extends across the width of the web 16 and hence on contact with the web in its dotted line path 16A, acts to sever the web across its entire width.

Webs 16 may be of print materials of different strengths. Should the serrated edge 24A of the flipper plate 24 be unable by itself to sever a particularly tough web 16, it has been found that its effectiveness may be enhanced by the use of a pusher bar 32 (FIGS. 3 and 4) which may be of plastic. Like the flipper plate 24, the pusher bar extends across the width of the web 16. It would be journaled at its ends in the mounting brackets 27. A rotary solenoid 34 is mounted on one of the end plates 27 and when energized rotates the free end of pusher bar 32 upwards into the path of the web 16 to force the web 16 more firmly against the serrated edge 24A of the flipper plate 24 to effect a better severing action. The rotary solenoid is timely energized by including it in a solenoid activate circuit 36 in parallel with the press stop circuitry 30 and in series with the wrap detector microswitch 28. Thus the pusher bar rotary solenoid 34 can be energized simultaneously with those controlling the press brakes and motors to insure timely severing of the broken web being wrapped.

Returning to FIG. 1, the web detector bar 26 is shown in a solid line rendition as near the blanket cylinders 10 and 12, and in a dotted line rendition as remote therefrom. Thus the wrap detector bar 26 is thus movable between two positions, and air cylinders 38 are employed to effect the displacement. As noted earlier, in operation it is desirable to have the web detector 26 as close to the wrap cylinder as possible in order to early sense the wrap and minimize it. In that position, it impairs access to and maintenance of the cylinders as on wrap occurrence. Thus removal to an out-of-the-way position, as by the air cylinders 38, is highly desirable. The displacement may be readily effected by arranging the mounting plates 27 for sliding movement on the main printing press frame. Arrangements may also exist to move the detector bar automatically up to the blanket cylinders on press-start, and automatically away therefrom on press-stop.

Figure 5:
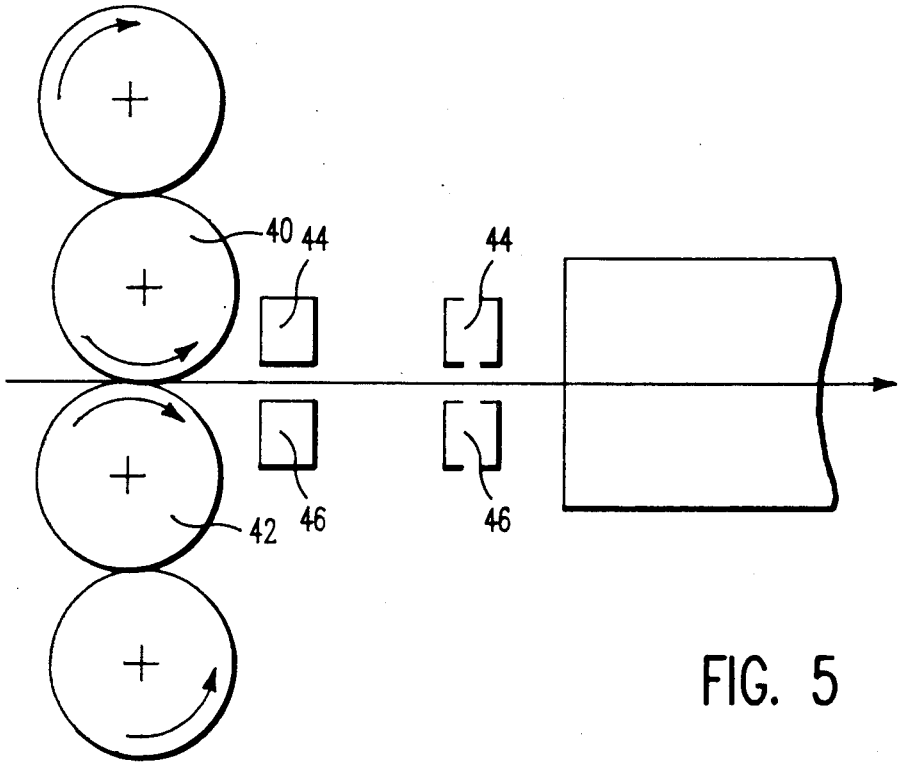
FIG. 5 is a schematic side view of a portion of a high speed printing press embodying two web wrap detectors because the arrangement of the blanket cylinders is such that the wrap on web break may occur on either cylinder.

As noted earlier, the configuration of the blanket cylinders may be such that they are vertically aligned, and the particular blanket cylinder to be wrapped on web break, uncertain. Stated otherwise, on web break, a wrap might occur on either blanket cylinders. FIG. 5 shows a situation having vertically aligned blanket cylinders 40 and 42 and one wherein two wrap detectors 44 and 46 are employed. (Dotted line renditions to which the wrap detectors may be withdrawn for access and maintenance purposes are also shown.)

Figure 6:
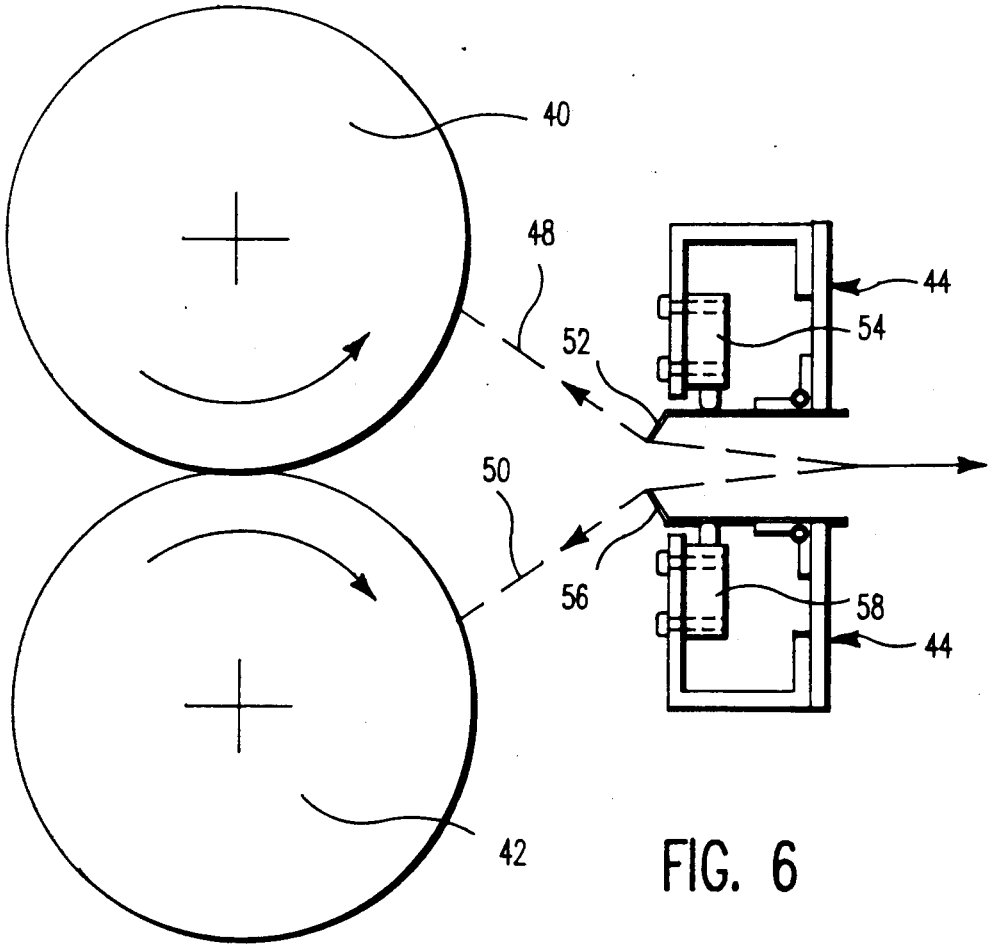
FIG. 6 is an enlarged schematic side view of a portion of the portion of the printing press of FIG. 5 and showing the two web wrap detectors in greater detail.

FIG. 6 shows the wrap detectors 44 and 46 of FIG. 5 in greater detail. The wrap path on web break may take either of dotted line paths 48 or 50. If the upper path 48 is taken as a result of the wrap occurring on upper blanket cylinder 40, the depending front edge of the hinged flipper plate 52 of wrap detector bar 44 will be engaged to deflect the plate to where it actuates an appropriately mounted microswitch 54 in suitable press stop circuits.

On the other hand, if the lower path 50 is taken as a result of wrap blanket cylinder 42, the upwardly extending front edge of upwardly-spring biased hinged flipper plate 56 will be engaged to depress it to activate microswitch 58 in a suitable press stop circuit, too. It will be evident that regardless of which blanket cylinder the wrap occurs, steps will be promptly taken to minimize the wrap.

It will be appreciated that applicant has invented an arrangement for quickly terminating web wrap on web break. The condition of web wrap is detected before a large amount of reverse travel of the web occurs, and suitable steps to stop blanket cylinder rotation are promptly taken. These protective steps are aided and abetted by incorporating a web severing mechanism in the wrap detection mechanism. The web severing action can be assisted by a positive web deflection mechanism. Utilization of principles of the invention can result in the wrap being limited to one-half the circumference of the blanket cylinder.

It should be observed that the web wrap/break detection mechanism is not in contact with the web during normal operation and so does not interfere with inking designs on the web.

It will also be appreciated that the above described apparatuses and methods are simply illustrative of the application of principles of the invention, and that numerous other apparatuses and methods may be readily devised by those skilled in the art and that fall within the spirit and scope of the invention.

What is claimed is:

1. In a printing press, a blanket cylinder subject to wrap on web break, and means for detecting the wrap to stop blanket cylinder rotation including a feeler finger having a cutting edge to cut the web, means mounting said feeler finger for limited displacement, and means contactable by said feeler finger when displaced to stop said blanket cylinder rotation.

2. A printing press according to claim 1, wherein the detecting means is normally out of contact with the web.

3. A printing press according to claim 1, wherein the detecting means senses a change in the path of the web.

4. A printing press according to claim 3, wherein the detecting means includes a feeler finger displaced by the web in assuming its changed path and means for mounting said feeler finger for displacement.

5. A printing press according to claim 3, wherein a microswitch is actuated by the displaced feeler finger.

6. A printing press according to claim 4, wherein the feeler finger extends across the width of the web.

7. A printing press according to claim 6, wherein the feeler finger is formed with a serrated edge for severing the web when engaged therewith.

8. A printing press according to claim 7, and means for urging the web in its changed path into firm engagement with the feeler finger serrated edge.

9. A printing press according to claim 8, wherein the urging means extends across the width of the web.

10. A printing press according to claim 9, wherein the urging means is of a plastic material.

11. A printing press according to claim 1, wherein the detecting means has an operative position near the cylinder, and is movable to another position remote therefrom to provide access to the cylinder, and means for moving the detecting means between the positions.

12. A printing press according to claim 1, wherein either of two coacting blanket cylinders may be subject to wrap, and a second means for detecting wrap on the second cylinder to stop blanket cylinder rotation.

13. In a printing press, a web break detector and a web severer including a feeler finger having a cutting edge to cut the web, means mounting said feeler finger for limited displacement, and means actuated by said feeler finger when displaced to stop the press.

14. For use in a printing press having a blanket cylinder subject to wrap, means for detecting a change in the path of the web including a feeler finger and a serrated edge cutting an engaging web, and means for responding to feeler finger displacement to stop the press operation.

15. In detecting means according to claim 14, wherein the feeler finger and serrated edge extends across the width of the web.

16. In detecting means according to claim 15, and means for urging the web in its changed path into firm engagement with the feeler finger serrated edge.

17. In a detecting means according to claim 16, wherein the urging means extends across the width of the web.

18. In a detecting means according to claim 17, wherein the urging means is made of plastic.

19. The method of protecting a printing press in the event of a web break resulting in a wrap on a blanket cylinder comprising, providing a feeler finger having a cutting edge to sever the web, mounting said feeler finger for limited displacement responsive to breakage of the web, providing a switch in the path of displacement of said feeler finger, and actuating said switch responsive to displacement of said feeler finger caused by the beginning of a wrap.

20. A printing press protecting method according to claim 19, and stopping the wrap in response to the actuation of the switch.

21. A printing press protecting method according to claim 20, wherein the wrap is stopped by stopping rotation of the blanket cylinder.

22. A printing press protecting method according to claim 19, wherein the beginning of the wrap is sensed by sensing a change in the path of the web.

* * * * *